US005360494A

United States Patent [19]

Brown

[11] Patent Number: 5,360,494

[45] **Date of Patent: * Nov. 1, 1994**

[54] METHOD FOR ALLOYING LITHIUM WITH POWDERED MAGNESIUM

[76] Inventor: Sanford W. Brown, 11328 Slallon Ave., Norwalk, Calif. 90650

[ * ] Notice: The portion of the term of this patent subsequent to Aug. 3, 2010 has been disclaimed.

[21] Appl. No.: 98,929

[22] Filed: Jul. 29, 1993

Related U.S. Application Data

[63] Continuation-in-part of Ser. No. 905,515, Jun. 29, 1992, Pat. No. 5,232,659.

[51] Int. Cl.[5] ..... B22F 1/00; B22F 3/02; B22F 3/16; C01D 15/00

[52] U.S. Cl. ..... 148/513; 75/255; 75/351; 419/38; 419/63; 419/34

[58] Field of Search ..... 419/30, 34, 35, 36, 419/38; 148/513

[56] References Cited

U.S. PATENT DOCUMENTS

| | | | |
|---|---|---|---|
| 4,158,689 | 6/1979 | Pett et al. | 264/63 |
| 4,225,345 | 8/1980 | Adee et al. | 75/211 |
| 4,248,630 | 2/1981 | Balmuth | 75/135 |
| 4,389,240 | 2/1983 | Erich et al. | 419/23 |
| 4,389,241 | 6/1983 | Schelleng | 75/0.5 R |
| 4,532,106 | 7/1985 | Pickens | 420/528 |
| 4,556,535 | 12/1985 | Bowman et al. | 420/580 |
| 4,721,599 | 1/1988 | Nakamura | 419/23 |
| 4,765,950 | 8/1988 | Johnson | 419/2 |
| 4,902,471 | 2/1990 | Penkunas et al. | 419/33 |
| 4,946,499 | 8/1990 | Sakuranda et al. | 73/343 |
| 5,232,659 | 8/1993 | Brown | 419/36 |

*Primary Examiner*—Donald P. Walsh
*Assistant Examiner*—Daniel Jenkins
*Attorney, Agent, or Firm*—Donald Diamond

[57] ABSTRACT

A powdered magnesium composition is mixed with lithium dispersed in an inert, non-water absorbent, liquid medium to produce a substantially homogenous admixture that is heated to melt the lithium and vaporize the liquid medium to thereby obtain a decovered powdered alloy comprising aluminum and lithium. The liquid medium has first and second liquid constituents, wherein the first liquid constituent has a boiling point below the melting point of lithium and the second liquid constituent has a boiling point above the melting point of lithium but below the melting point of the alloy being produced.

16 Claims, No Drawings

METHOD FOR ALLOYING LITHIUM WITH POWDERED MAGNESIUM

CROSS-REFERENCE TO RELATED APPLICATION

This application is a continuation-in-part of U.S. Pat. Application Ser. No. 07/905,515 filed Jun. 29, 1992 now U.S. Pat. No. 5,232,659. entitled Method For alloying Lithium With Powdered Aluminum, which is incorporated herein by reference.

BACKGROUND OF THE INVENTION 1. Field of the Invention

This invention relates to powdered alloys and, more particularly, to a method for alloying lithium with a powdered magnesium composition.

2. Prior Art

There has been an ongoing effort to develop high strength aluminum alloys that would be characterized by stronger, stiffer and lighter weight properties and which would be adapted for use in diverse areas such as aircraft, aerospace, automotive, naval, and electrical industries. While high strength is particularly important, the aluminum alloy must also meet a combination of property requirements such as density, strength, ductility, toughness, fatigue and corrosion resistance, with specific requirements being a function of the end use of the alloy. It is known in the art that high strength, lighter weight aluminum alloys can be obtained by alloying aluminum with lithium and that one or more additional alloying elements can be included in the alloys to provide suitable properties for particular end uses.

The general characteristics of aluminum-lithium alloys are described in the Encyclopedia of Science And Chemical Technology, 6th Ed., 1987, Vol. 1 at Page 426. In this reference, it is disclosed that the addition of lithium to aluminum provides an alloy that is characterized by low density, an increase in elastic modulus (stiffness), and an increase in strength. It is pointed out that lithium is the lightest metal in existence and that for each weight percent of lithium added to aluminum, there is a corresponding decrease of 3% (theoretical is 5%) in the alloy's weight. It is noted that as the amount of lithium in the alloy is increased, there is a corresponding increase in strength due to the presence of very small precipitates which act as strengthening agents with respect to the aluminum and that as the precipitates grow during heat treatment, the strength increases to a limit and then begins to decrease. Accordingly, it is pointed out that aluminum-lithium alloys come under the classification of precipitation-strengthening alloys and that they are also classifiable as heat-treatable because the size and distribution of the precipitates can be controlled by heat treating. Also, it is reported that the addition of lithium to aluminum results in an alloy with unacceptable (low) levels of ductility for many applications and, therefore, other elements such as copper, magnesium and zirconium have been included in the alloy to offset the loss in ductility; however, it is further reported that these alloy additions, particularly copper, increase the alloy density and, therefore, the development of alloy formulations has focused on balancing the various positive an negative attributes of the different elements, to arrive at composition with suitable properties.

It would be advantageous to provide a high strength magnesium-lithium alloy which has the beneficial properties hereinabove described for aluminum-lithium alloys, but which it substantially lighter and, therefore, more cost effective with respect to end use applications.

U.S. Pat. 3,563,730 (Bach et al., 1971) discloses, in Example 7, a method for preparing magnesium-lithium alloys in particulate form which comprises mixing a dispersion of molten lithium in mineral oil with granular or powdered magnesium at a temperature above the melting point of lithium but below the melting point of the alloy to be produced, and continuing the mixing until alloying has been effectively achieved.

SUMMARY OF THE INVENTION

In accordance with this invention, there is provided a method for alloying lithium with a powdered magnesium composition which comprises (a) mixing a powdered magnesium composition with lithium dispersed in an inert, non-water absorbent, liquid medium to obtain a substantially homogenous admixture, wherein the liquid medium comprises substantially mutually exclusive fractions of first and second liquid constituents of differentiating boiling points, with the first liquid constituent having a boiling point below the melting point of lithium and the second liquid constituent having a boiling point above the melting point of lithium but below the melting point of the alloy being produced, and (b) heating the admixture to melt the lithium and vaporize the liquid medium to thereby obtain a decovered powdered alloy comprising magnesium and lithium.

DETAILED DESCRIPTION

The lithium dispersion which can be used in the practice of this invention to prepare magnesium-lithium alloys comprises lithium dispersed in an inert, non-water absorbent, liquid medium which has first and second liquid constituents. A principal characteristic of the first liquid constituent is that it has a boiling point below the melting point of lithium. A principal characteristic of the second liquid constituent is that it has a boiling point above the melting point of lithium but below the melting point of the alloy being produced. The melting point of lithium is 179° C. (345° F.).

The first liquid constituent, which advantageously has a boiling point from about 65° C. (149° F.) to about 150° C. (302° F.), is generally present in the lithium dispersion in an amount from about 0.5 to about 2.0 parts by weight per 1.0 part by weight of lithium and, preferably, is present in the lithium dispersion in an amount from about 0.75 to about 1.5 parts by weight per 1.0 part by weight of lithium. The inert, non-water absorbent, first liquid constituent is, desirably, a liquid hydrocarbon selected from the group consisting of aliphatic compounds, aromatic compounds and mixtures thereof. A preferred first liquid constituent is hexane.

The second liquid constituent, which advantageously has a boiling point above the melting point of lithium but below the melting point of the alloy being formed, is generally present in the lithium dispersion in an amount from about 0.5 to about 2.0 parts by weight per 1.0 part by weight of lithium and, preferably, is present in the lithium dispersion in an amount from about 0.75 to about 1.5 parts by weight per 1.0 part by weight of lithium. A preferred second liquid constituent is mineral oil, a liquid hydrocarbon composition having a boiling point range from about 330° C. (626° F.) to about 390° C. (734° F.).

The powdered magnesium compositions which can be used in the practice of this invention can have a particle size range from about −40 to +325 mesh. The powdered magnesium composition can be (a) substantially powdered magnesium or (b) powdered magnesium blended with one or more powdered alloying elements such as silicon, iron, copper, manganese, aluminum, chromium, nickel, zinc, gallium, vanadium, titanium, zirconium, tin, cobalt, boron, bismuth, lead, or beryllium, or (c) a pre-alloyed powdered composition containing one or more of the aforesaid alloying elements, or (d) a mixture of any of the foregoing.

In carrying out the method of this invention for alloying lithium with a powdered magnesium composition, the powdered magnesium composition is mixed with the lithium dispersion to obtain a substantially homogenous admixture which is heated to melt the lithium and vaporize the liquid constituents of the lithium dispersion to thereby obtain a decovered powdered alloy comprising magnesium and lithium. The amount of lithium used in the alloying procedure is so selected as to provide the powdered alloy with a lithium concentration in an amount from about 0.5 to about 10.0 percent by weight. As to other alloying elements that can be advantageously included in the admixture which defines the alloy precursor, their concentration is so selected as to provide the powdered alloy with suitable properties for particular end uses. When the second liquid constituent in the lithium dispersion is mineral oil, the admixture is advantageously heated to about 343° C. (650° F.) to melt the lithium and vaporize the liquid constituents. The powdered alloy has a nominal density from about 0.053 to about 0.060.

Following alloy formation, the powdered magnesium lithium alloy is poured into a compaction die and compacted to at least 85% of theoretical density by employing a suitable compaction force as, for example, 10–15 tons per square inch. The resulting compaction product or billet may be further compacted to at least about 98% of theoretical density by subjecting the billet to a second compaction step. Upon completion of the compaction process, the billet is sintered at a temperature from about 426° C. (800° F.) to about 454° C. (850° F.) for about 30 minutes. Thereafter, the sintered billet can be extruded at a suitable temperature as, for example, a temperature from about 399° C. (750° F.) to about 454° C. (850° F.) to form pre-selected tubular configurations that can be used in diverse applications, including sporting goods such as archery arrows and golf club shafts.

The following examples further illustrate the method of this invention.

EXAMPLE I

A powdered magnesium composition was prepared by blending the following powdered ingredients in a "V" blender at 20 rpm for 30 minutes:

| Ingredients | Wt., Grams | Mesh Size |
|---|---|---|
| Magnesium | 100 | −40 to +325 |
| Cadmium | 5.5 | +325 |

The blended powder was transferred to a mixing and heating, round bottom, stainless steel bowl and a lithium dispersion containing 5.5 grams of lithium powder, 5.5 grams of mineral oil and 11 grams of hexane was admixed with the blended powder to obtain a substantially homogenous admixture which was heated under a hood at 343° C. (650° F.) until vaporization of the liquid components ceased, about 30 minutes.

The resulting powdered alloy comprising magnesium and lithium, after cooling, can be placed in a compaction die and compacted into a billet at a compaction force of about 12.5 tons per square inch. Thereafter, the compacted billet can be heated to 800° F. (426° C.) and extruded into a tubular configuration.

EXAMPLE II

Following the procedure of Example I, a powdered alloy was prepared by admixing (i) a powdered magnesium composition containing 100 grams of magnesium and 2.1 grams of zinc with (ii) a lithium dispersion containing 2.1 grams of lithium powder, 2.1 grams of mineral oil and 4.2 grams of hexane, and heating the admixture to vaporize the liquid components.

EXAMPLE III

Following the procedure of Example I, a powdered alloy was prepared by admixing (i) a powdered magnesium composition containing 100 grams of magnesium and 2.5 grams of iron with (ii) a lithium dispersion containing 2.5 grams of lithium powder, 2.5 grams of mineral oil and 5 grams of hexane, and heating the admixture to vaporize the liquid components.

EXAMPLE IV

Following the procedure of Example I, a powdered alloy was prepared by admixing (1) a powdered magnesium composition containing 100 grams of magnesium and 4 grams of iron with (ii) a lithium dispersion containing 5 grams of lithium powder, 5 grams of mineral oil and 10 grams of hexane, and heating the admixture to vaporize the liquid components.

EXAMPLE V

Following the procedure of Example I, a powdered alloy was prepared by admixing (1) a powdered magnesium composition containing 100 grams of magnesium, 6.5 grams of iron and 1.1 grams of aluminum with (ii) a lithium dispersion containing 2.1 grams of lithium powder, 2.1 grams of mineral oil and 4.2 grams of hexane, and heating the admixture to vaporize the liquid components.

EXAMPLE VI

Following the procedure of Example I, a powdered alloy was prepared by admixing (1) a powdered magnesium composition containing 100 grams of magnesium, 6.5 grams of iron, 4 grams of aluminum and 3 grams of zinc with (ii) a lithium dispersion containing 4 grams of lithium powder, 4 grams of mineral oil and 8 grams of hexane, and heating the admixture to vaporize the liquid components.

In view of the foregoing description and examples, it will become apparent to those of ordinary skill in the art that equivalent modifications thereof may be made without departing from the spirit and scope of this invention.

That which is claimed is:

1. A method for alloying lithium with a powdered magnesium composition, which comprises:

mixing a powdered magnesium composition with lithium dispersed in an inert, non-water absorbent, liquid medium to obtain a substantially homogenous admixture, said liquid medium comprising substantially mutually exclusive fractions of first and second liquid constituents, of differentiating boiling points, said first liquid constituent having a boiling point below the melting point of lithium, said second liquid constituent having a boiling point above the melting point of lithium but below the melting point of the alloy being produced, and heating said admixture to melt said lithium and vaporize said liquid medium to thereby obtain a decovered powdered alloy comprising magnesium and lithium.

2. The method of claim 1 wherein the first liquid constituent has a boiling point from about 65° C. to about 150° C.

3. The method of claim 2 wherein the concentration of the first liquid constituent is from about 0.5 to about 2.0 parts by weight per 1.0 part of weight by lithium.

4. The method of claim 2 wherein the concentration of the first liquid constituent is from about 0.75 to about 1.5 parts by-weight per 1.0 part by weight of lithium.

5. The method of claim 3 wherein the first said constituent is a liquid hydrocarbon.

6. The method of claim 5 wherein the liquid hydrocarbon is a member selected from the group consisting of aliphatic compounds, aromatic compounds and mixtures thereof.

7. The method of claim 3 wherein the concentration of the second liquid constituent is from about 0.5 to about 2.0 parts by weight per 1.0 part by weight of lithium.

8. The method of claim 3 wherein the concentration of the second liquid constituent is from about 0.75 to about 1.5 parts by weight per 1.0 part by weight of lithium.

9. The method of claim 7 wherein the second liquid constituent is mineral oil.

10. The method of claim 9 wherein the admixture is heated to a temperature above the boiling point of mineral oil but below the melting point of the alloy being formed to melt the lithium and to vaporize the liquid constituents.

11. The method of claim 10 wherein the first liquid constituent is hexane.

12. The method of claim 1 wherein the powdered alloy comprising magnesium and lithium is compacted to at least about 85% of theoretical density.

13. The method of claim 12 wherein the compacted powdered alloy is sintered at a temperature from about 426° C. to about 454° C.

14. The method of claim 1 wherein the powdered magnesium composition comprises a pre-alloyed magnesium composition.

15. The method of claim 1 wherein the admixture includes an additional alloying ingredient selected from the group consisting of silicon, iron, copper, manganese, aluminum, chromium, nickel, zinc, gallium, vanadium, titanium, zirconium, tin, cobalt, boron, bismuth, lead, beryllium, cadmium and mixtures thereof.

16. The method of claim 1 wherein the amount of lithium is so selected as to provide the powdered alloy with a lithium concentration in an amount from about 0.5 to about 10.0% by weight.

* * * * *